US010287123B2

(12) United States Patent
Pedercini et al.

(10) Patent No.: US 10,287,123 B2
(45) Date of Patent: May 14, 2019

(54) ASSEMBLY FOR FEEDING BACKING RIBBON FOR LABELING PRODUCTS TO BE LABELED

(71) Applicant: SACMI VERONA S.P.A., Imola (IT)

(72) Inventors: Maurizio Pedercini, Marmirolo (IT); Matteo Grioni, Castellucchio (IT); Alessandro Gazzini, San Benedetto Po (IT)

(73) Assignee: SACMI VERONA S.P.A., Imola (IT)

( * ) Notice: Subject to any disclaimer, the term of this patent is extended or adjusted under 35 U.S.C. 154(b) by 0 days.

(21) Appl. No.: 15/906,608

(22) Filed: Feb. 27, 2018

(65) Prior Publication Data

US 2018/0186590 A1 Jul. 5, 2018

Related U.S. Application Data

(62) Division of application No. 14/904,859, filed as application No. PCT/IB2014/063092 on Jul. 14, 2014.

(30) Foreign Application Priority Data

Jul. 16, 2013 (IT) ..... VR2013A0163

(51) Int. Cl.
*B65H 19/18* (2006.01)
*B65C 9/18* (2006.01)
(Continued)

(52) U.S. Cl.
CPC ..... *B65H 19/1842* (2013.01); *B65C 9/08* (2013.01); *B65H 19/1852* (2013.01);
(Continued)

(58) Field of Classification Search
CPC .. B65H 19/102; B65H 19/1852; B65H 21/00; B65H 2301/46011; B65H 2301/46014;
(Continued)

(56) References Cited

U.S. PATENT DOCUMENTS 3,253,544 A 5/1966 Von
4,157,934 A 6/1979 Ryan et al.
(Continued)

FOREIGN PATENT DOCUMENTS

CN 101223093 A 7/2008
CN 102020042 A 4/2011
(Continued)

OTHER PUBLICATIONS

Intenational Search Report; Intenational Application No. PCT/IB2014/063092; International Filing Date Jul. 14, 2014; dated Feb. 11, 2015; 3 pages.
(Continued)

*Primary Examiner* — Mark A Osele
(74) *Attorney, Agent, or Firm* — Cantor Colburn LLP

(57) ABSTRACT

An assembly for feeding backing ribbon for adhesive labels for labeling products to be labeled, comprising a splicing device and at least two supporting elements for the backing ribbon, the splicing device being intended to perform on command the splice between a first splicing region, formed on a first backing ribbon being unwound from a first supporting element, and a second splicing region, formed on a second backing ribbon wound on a second supporting element, the first backing ribbon supporting a plurality of adhesive labels which are arranged, mutually spaced, on the face directed toward the second splicing region; the first backing ribbon having, when associated with the respective first supporting element, at least one portion that is free from self-adhesive labels and forms the first splicing region; the portion is located substantially at the end of the first backing ribbon that is associated with the first supporting element.

10 Claims, 3 Drawing Sheets

(51) Int. Cl.
*B65H 21/00* (2006.01)
*B65C 9/08* (2006.01)
*B65H 26/06* (2006.01)

(52) U.S. Cl.
CPC ..... *B65H 21/00* (2013.01); *B65H 26/063* (2013.01); *B65H 2301/46014* (2013.01); *B65H 2301/4622* (2013.01); *B65H 2301/46174* (2013.01); *B65H 2301/46412* (2013.01); *B65H 2701/192* (2013.01)

(58) Field of Classification Search
CPC .. B65H 2301/4607; B65H 2301/46174; B65H 2301/46314; B65H 2301/46412; B65H 2301/4622
See application file for complete search history.

(56) References Cited

U.S. PATENT DOCUMENTS

| | | | | |
|---|---|---|---|---|
| 4,331,301 | A | 5/1982 | Martinez | |
| 4,417,940 | A | 11/1983 | Koster | |
| 4,473,430 | A | 9/1984 | Voltmer et al. | |
| 4,481,053 | A | 11/1984 | Tokuno et al. | |
| 4,555,281 | A | 11/1985 | Mattei et al. | |
| 5,086,987 | A * | 2/1992 | Shieh | B65H 18/28 156/184 |
| 5,643,395 | A | 7/1997 | Hinton | |
| 2008/0196819 | A1 | 8/2008 | Hafner | |

FOREIGN PATENT DOCUMENTS

| | | | |
|---|---|---|---|
| CN | 102405437 | A | 4/2012 |
| CN | 102582076 | A | 7/2012 |
| CN | 202729407 | U | 2/2013 |
| DE | 102005033486 | A1 | 1/2007 |
| EP | 0758612 | A1 | 2/1997 |
| GB | 2189226 | A | 10/1987 |
| JP | 2003128027 | A | 5/2003 |
| WO | 2005110902 | A1 | 11/2005 |

OTHER PUBLICATIONS

Written Opinion of the International Searching Authority; International Application No. PCT/IB2014/063092; International Filing Date Jul. 14, 2014; dated Feb. 11, 2015; 5 pages.

* cited by examiner

ASSEMBLY FOR FEEDING BACKING RIBBON FOR LABELING PRODUCTS TO BE LABELED

CROSS REFERENCE TO RELATED APPLICATIONS

This application is a divisional of U.S. patent application Ser. No. 14/904,859, filed on Jan. 13, 2016, which is a U.S. National Stage of PCT International Application No. PCT/IB2014/063092, filed on Jul. 14, 2014, which claims priority to IT Application No. VR2013A000163, filed on Jul. 16, 2013, the disclosure of all of which is incorporated herein by reference in its entirety.

TECHNICAL FIELD

The present disclosure relates to a method and an assembly for feeding backing ribbon for labeling products to be labeled.

BACKGROUND

Conventional labeling machines use labels applied on a backing ribbon, from which they must be removed to be placed on products to be labeled.

These labeling machines have a ribbon feeding assembly constituted by at least one spool of ribbon, which supports the labels and which is unwound progressively.

The ribbon unwound from the feeder spool is transferred to a label application assembly, which is provided with a device intended to detach the labels from the ribbon and apply them on the products to be labeled.

Finally, the backing ribbon is transferred to an assembly for recovering the used backing ribbon.

In order to try to reduce machine downtimes, while the label backing ribbon is being unwound from a first spool, the operator prepares a second spool of ribbon that supports the labels, applying, at the free end of said ribbon, a double-adhesive element and arranging said free end at a splicing station, which has the purpose of joining the backing ribbon of the spool about to be depleted to the ribbon of the new spool.

This operation does not entail particular problems if the spool about to be depleted supports the labels on the face that is arranged opposite to the position of the ribbon of the new spool.

However, if the labels of the spool about to be depleted face the ribbon of the new spool, it is evident that it is not possible to perform the splice, since the double adhesive would be applied on a region with labels and therefore, once the label application assembly is reached, separation would occur between the depleted ribbon and the end of the ribbon of the new spool on which the double adhesive had been applied.

As a consequence, in traditional labeling machines, when the feeder spool with the labels facing the ribbon to be spliced is depleted, the operator stops the labeling machine to remove manually the labels supported by the ribbon about to be depleted, so as to be able to engage the end of the new spool preset with the double adhesive with the region of the ribbon about to be depleted from which the label has been removed.

It is evident that known solutions have the drawback of having to stop periodically the labeling machine to attach the label backing ribbon wound on the new feeder spool to the ribbon of the spool about to be depleted.

In order to try to solve this drawback, a solution has been proposed which uses a device for the automated separation of the labels supported by the ribbon of the spool about to be depleted.

This solution, described for example in patent EP 1904390 B1 in the name of Krones, despite being valid from a conceptual standpoint, is constructively complicated.

The aim of the present disclosure is to solve the problems and obviate the drawbacks described above, providing an assembly for feeding backing ribbon for labeling products to be labeled that is considerably easier and more practical to use than conventional assemblies.

SUMMARY

Within the scope of this aim, the disclosure provides a feeder assembly that avoids the necessity of stopping the labeling machine periodically.

The disclosure proposes an assembly for feeding backing ribbon for labeling products to be labeled that is extremely reliable.

BRIEF DESCRIPTION OF THE DRAWINGS

Further characteristics and advantages of the disclosure will become more apparent from the description of some preferred but not exclusive embodiments of an assembly for feeding backing ribbon for labeling products to be labeled according to the disclosure, illustrated by way of non-limiting example in the accompanying drawings, wherein.

Figure 1:
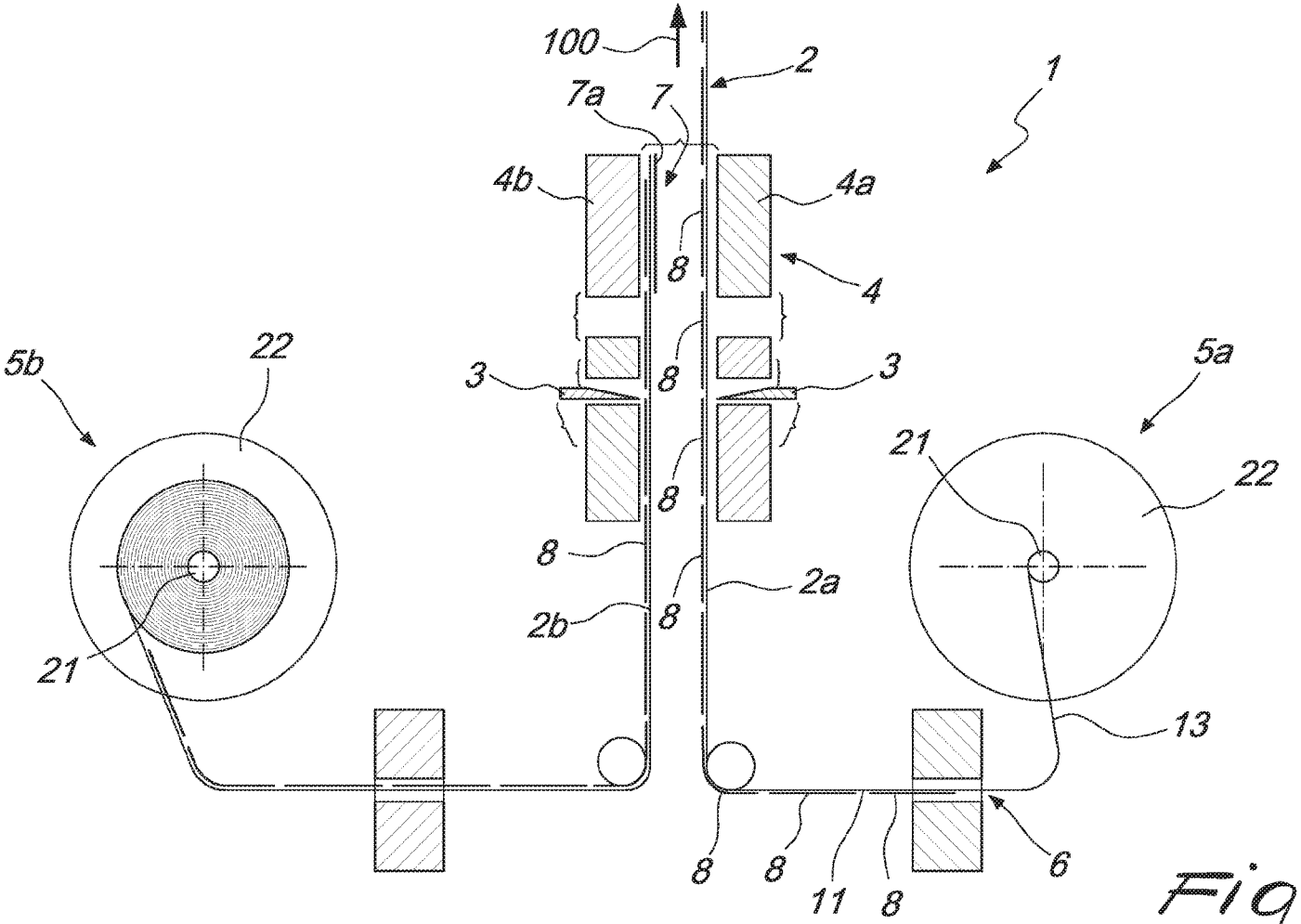
FIG. 1 is a schematic view of an assembly for feeding backing ribbon for labeling products to be labeled directly before the splicing step.
Figure 2:
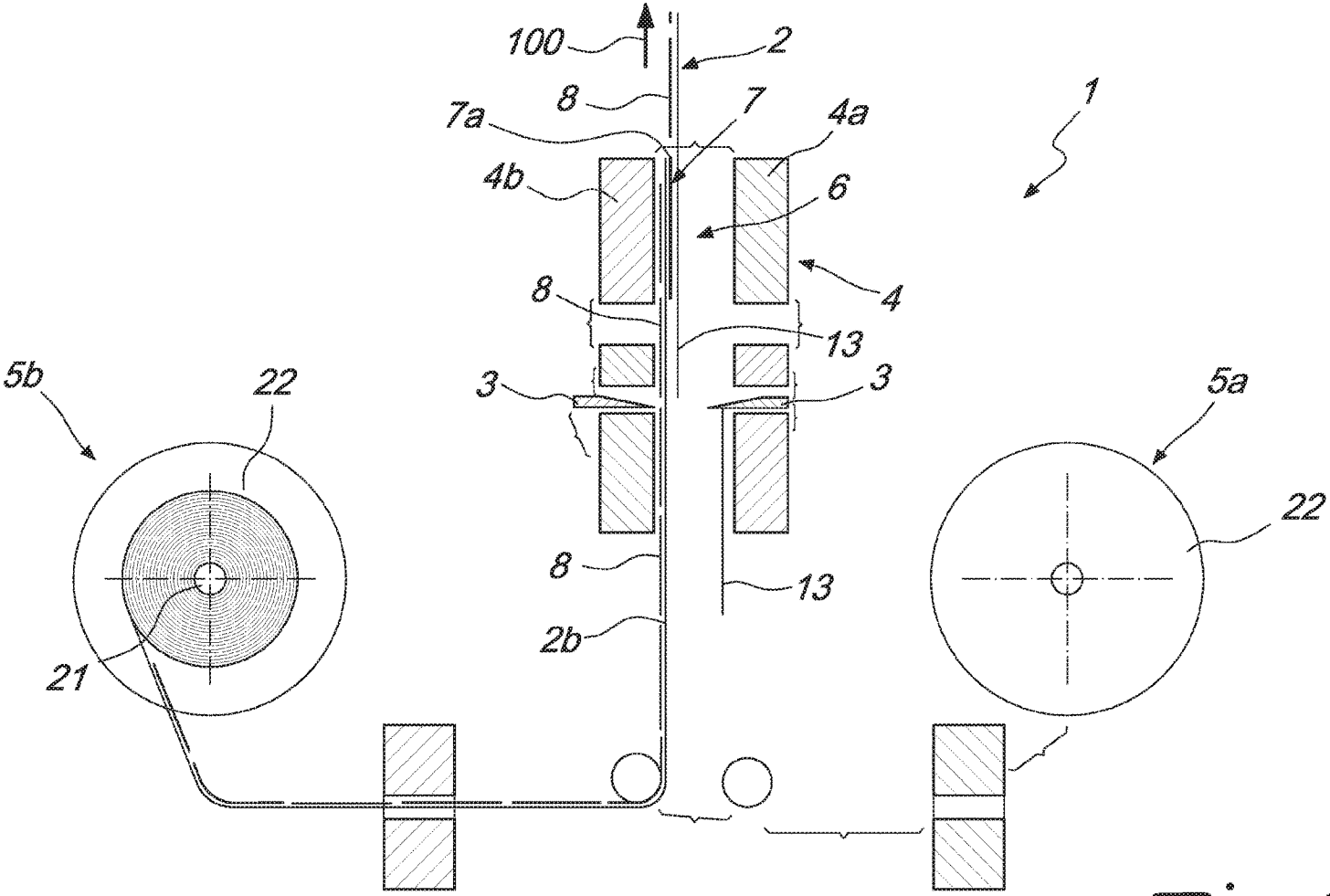
FIG. 2 is a schematic view of an assembly for feeding backing ribbon for labeling products to be labeled directly after the splicing step.
Figure 3:
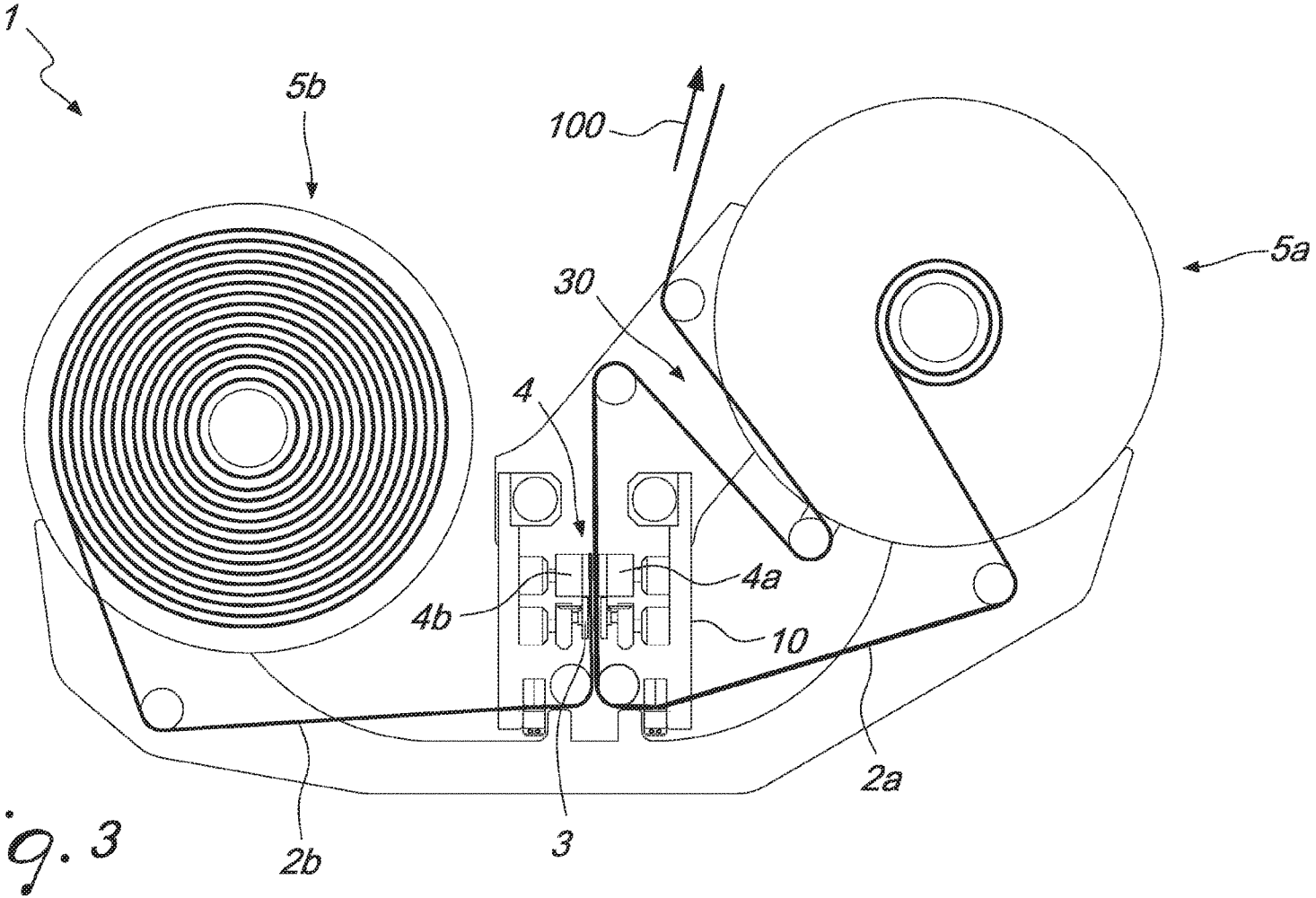
FIG. 3 is a schematic view of the feeder assembly according to the disclosure.

In the examples of embodiment that follow, individual characteristics, given in relation to specific examples, may actually be interchanged with other different characteristics that exist in other examples of embodiment.

DETAILED DESCRIPTION OF THE DRAWINGS

With reference to the cited figures, the present disclosure relates to an assembly, generally designated by the reference numeral 1, for feeding backing ribbon 2 for adhesive labels for labeling products to be labeled.

According to the present disclosure, the feeder assembly 1 comprises a splicing device 4 and at least two supporting elements 5*a*, 5*b* for the backing ribbon 2.

In particular, the splicing device 4 is intended to perform on command the splicing between a first splicing region, designated by the reference numeral 6 and formed on a first backing ribbon 2*a* that is unwound from a first supporting element 5*a*, and a second splicing region, designated by the reference numeral 7 and formed on a second backing ribbon 2*b* wound on a second supporting element 5*b*.

The first backing ribbon 2*a* supports a plurality of adhesive labels 8, which are arranged, mutually spaced, on the face 11 that is directed toward the second splicing region 7.

The second backing ribbon 2*b* also supports a plurality of adhesive labels 8, which are arranged, mutually spaced, on the face that lies opposite the one on which the second splicing region 7 is provided.

Conveniently, the end of the first backing ribbon 2*a* is associated with a central body 21. Said end is connected, for example by means of an adhesive tape, to the central body 21, which is supported rotatably by a supporting disk 22 of the first supporting element 5*a*.

However, nothing prevents the provision, in some applications, of the movement, by motor means, of the central body 21 about the unwinding axis of the spool of ribbon 2*a*: in this case, the central body 21 conveniently rotates integrally with the supporting disk 22.

The first splicing region 6 comprises at least one portion 13 of the first ribbon 2*a* that is free from self-adhesive labels 8 and is arranged substantially at the end of the first backing ribbon 2*a* that is associated with the first supporting element 5*a*.

In particular, the portion 13 of the first backing ribbon 2*a* is, when the first backing ribbon is associated with the respective supporting element 5*a* and more generally with the feeder assembly 1, free from self-adhesive labels 8.

This portion 13 forms the first splicing region 6.

The portion 13 is defined substantially at the tail of the first backing ribbon 2*a* with respect to the unwinding direction.

Specifically, the portion 13 is arranged substantially at the end of the first backing ribbon 2*a* that is associated with the first supporting element 5*a*.

Conveniently, the feeder assembly 1 comprises a cutting device 3, which is adapted to cut, on command, the portion 13 free from self-adhesive labels 8 upstream of the first splicing region 6 with respect to the advancement direction, designated by the arrow 100, of the backing ribbon 2.

Preferably, the cut is performed directly upstream of the first splicing region 6 with respect to the advancement direction 100.

Advantageously, the feeder assembly 1 has a cutting and splicing station, designated by the reference numeral 10 in the figures, which supports the cutting device 3 and the splicing device 4.

Said cutting and splicing station 10 is arranged downstream of the supporting elements 5*a* and 5*b* along the advancement direction 100 of the backing ribbon 2 and supports the cutting device 3 and the splicing device 4.

According to a preferred embodiment, the cutting device 3 is adapted to cut the first backing ribbon 2*a* simultaneously with or after the splicing between the first splicing region 6 and the second splicing region 7 by the splicing device 4.

According to a practical embodiment, the second splicing region 7 can be constituted by a double-adhesive sheet-like element 7*a*, which is associated with the free end of the second backing ribbon 2*b* and is arranged so as to face, during the splicing operations, the first splicing region 6.

Preferably, the splicing device 4 comprises a pair of pads 4*a*, 4*b* adapted to bring the first splicing region 6 and the second splicing region 7 into mutual contact.

In order to allow optimum splicing between the first splicing region 6 and the second splicing region 7, the feeder assembly 1 can be associated with the accumulation device, designated by the reference numeral 30, of the backing ribbon 2 arranged downstream of the splicing device 4.

The accumulation device 30 can be constituted for example by guiding elements or dandy rolls that can be moved on command.

The two supporting elements 5*a*, 5*b* are supported conveniently by a supporting frame on opposite sides with respect to the cutting and splicing station 10.

According to a particularly important aspect of the present disclosure, the feeder assembly 1 is associated functionally with a device for detecting a parameter related to the first backing ribbon 2*a* that is unwound from the first supporting element 5*a*.

In particular, the detection device is adapted to actuate the splicing device 4 once said parameter has been detected.

Preferably, the detection device is adapted to detect the portion 13 of the first ribbon 2*a* that is free from self-adhesive labels 8.

According to a preferred embodiment, the detection device comprises a first detector, arranged advantageously at the first supporting element 5*a*, which is intended to detect that the backing ribbon 2*a* that is still wound on the central body 21 is equal to, or less than, a preset value.

By way of example, the first sensor can be constituted by a device for measuring the radius of the ribbon 2*a* wound on the central body 21.

The first sensor is intended to activate, once it has detected that the backing ribbon 2*a* still wound on the central body 21 is equal to, or less than, a preset value (and that therefore the backing ribbon 2*a* to be unwound is close to depletion), a second sensor, which is arranged between the first supporting element 5*a* and the splicing device 4; said second sensor is constituted, for example, by a sensor adapted to identify the labels 8.

The second sensor, once the absence of labels 8 has been detected, identifies indirectly the portion 13 that is free from labels 8 and actuates the splicing device 4 to allow it to mutually connect the second splicing region 7 and the first splicing region 6 formed at the portion 13 that is free from labels 8.

According to a further aspect, the present disclosure relates to a labeling machine.

The labeling machine comprises a feeder assembly as described above, an assembly for applying the labels on products to be labeled, and an assembly for taking up the backing ribbon.

The operation of the assembly 1 for feeding the backing ribbon 2 according to the disclosure is evident from what has been described above.

During the operation of the labeling machine, the backing ribbon 2*a*, with the adhesive labels 8 applied thereon, feeds the application assembly to the containers to be labeled so that the adhesive labels 8 can be applied.

When the detection device, constituted for example by the second sensor arranged upstream of the cutting and splicing station 10, detects the absence of labels 8 and therefore the portion 13 of the first ribbon 2*a* that is free from self-adhesive labels 8, it actuates the splicing device 4, which performs the splicing, and optionally the cutting, of the first backing ribbon 2*a*, splicing it to the second backing ribbon 2*b* previously prepared and wound on the second supporting element 5*b*.

All the characteristics of the disclosure indicated above as advantageous, convenient or the like may also be omitted or be replaced with equivalents.

The individual characteristics described with reference to general teachings or to particular embodiments may all be present in other embodiments or may replace characteristics in these embodiments.

In practice it has been found that the disclosure is able to achieve fully the intended aim in all of its embodiments.

The disclosure thus conceived is susceptible of numerous modifications and variations, all of which are within the scope of the accompanying claims.

In practice, the materials used, so long as they are compatible with the specific use, as well as the shapes and dimensions, may be any according to the requirements.

All the details may furthermore be replaced with other technically equivalent elements.

The disclosures in Italian Patent Application no. VR2013A000163, from which this application claims priority, are incorporated herein by reference.

The invention claimed is:

1. A method for feeding a backing ribbon for adhesive labels for labeling products to be labeled, comprising the following steps:

providing a splicing device and at least two supporting elements for said backing ribbon;

performing on command a splice between a first splicing region, formed on a first backing ribbon being unwound from a first supporting element, and a second splicing region, formed on a second backing ribbon wound on a second supporting element, said first backing ribbon supporting a plurality of adhesive labels which are arranged, mutually spaced, on the face directed toward said second splicing region, said first backing ribbon having, when it is associated with the respective supporting element, at least one portion that is free from self-adhesive labels and forms said first splicing region, said at least one portion being located substantially at the end of said first backing ribbon that is associated with said first supporting element.

2. The method according to claim 1, comprising cutting on command said portion free from adhesive labels upstream of said first splicing region with respect to the advancement direction of said backing ribbon with a cutting device.

3. The method according to claim 1, comprising supporting said cutting device and said splicing device with a cutting and splicing station.

4. The method according to claim 3, comprising cutting said first backing ribbon simultaneously with or after the splice between said first splicing region and said second splicing region on the part of said splicing device with said cutting device.

5. The method according to claim 1, comprising providing said second splicing region with a double-adhesive sheet-like element, which is associated with the free end of said second backing ribbon and is arranged so as to face said first splicing region during splicing operations.

6. The method according to claim 1, comprising moving mutually into contact said first splicing region and said second splicing region by a pair of pads of said splicing device.

7. The method according to claim 1, comprising accumulating the backing ribbon that is arranged downstream of said splicing device with an accumulating device.

8. The method according to claim 1, comprising supporting said at least two supporting elements by a supporting frame on opposite sides with respect to said cutting and splicing station.

9. The method according to claim 1, comprising associating functionally said feeder assembly with a device for detecting a parameter related to the first backing ribbon that is unwound from said first supporting element, said detection device being adapted to control, once said parameter has been detected, said splicing device.

10. The method according to claim 9, comprising detecting said portion of said first ribbon that is free from adhesive labels with said detection device.

* * * * *